US008242669B2

(12) United States Patent
Qiu

(10) Patent No.: US 8,242,669 B2
(45) Date of Patent: Aug. 14, 2012

(54) LED LIGHT DEVICE

(75) Inventor: Fu jun Qiu, Ningbo (CN)

(73) Assignee: Ningbo Futai Electric Co., Ltd., Ningbo, Zhejiang (CN)

( * ) Notice: Subject to any disclaimer, the term of this patent is extended or adjusted under 35 U.S.C. 154(b) by 101 days.

(21) Appl. No.: 12/799,394

(22) Filed: Apr. 22, 2010

(65) Prior Publication Data

US 2011/0260599 A1 Oct. 27, 2011

(51) Int. Cl.
*H05B 33/00* (2006.01)
*H01J 61/52* (2006.01)

(52) U.S. Cl. ..... 313/46; 313/512; 362/294; 362/800; 362/547; 362/264; 362/373; 165/58

(58) Field of Classification Search ..... None
See application file for complete search history.

(56) References Cited

U.S. PATENT DOCUMENTS

| | | | | |
|---|---|---|---|---|
| 7,699,501 | B2 * | 4/2010 | Liu | 362/294 |
| 7,771,082 | B2 * | 8/2010 | Peng et al. | 362/249.02 |
| 7,800,119 | B2 * | 9/2010 | He et al. | 257/79 |
| 2010/0164348 | A1 * | 7/2010 | Huang et al. | 313/46 |

* cited by examiner

*Primary Examiner* — Ashok Patel
(74) *Attorney, Agent, or Firm* — Raymond Y. Chan; David and Raymond Patent Firm

(57) ABSTRACT

A LED light device includes a light-emitting diode assembly including a light body and one or more LEDs supporting thereat, and a heat dissipating arrangement including a plurality of heat dissipating fins radially and outwardly extended from the light body to define a heat dissipating channel between every two of the heat dissipating fins, and an air guiding member coupled at the front side of the light body. Each of the heat dissipating channels has a front opening extended at the front side of the light body and an elongated side opening for dissipating heat generated from the LED assembly. An air guiding member has a plurality of guiding inlets aligning with the front openings of the heat dissipating channels respectively for guiding air flowing to the heat dissipating channels so as to effectively dissipating the heat from the LED assembly through the heat dissipating fins.

16 Claims, 4 Drawing Sheets

LED LIGHT DEVICE

BACKGROUND OF THE PRESENT INVENTION

1. Field of Invention

The present invention relates to a light-emitting diode (LED) device for lighting purpose, and more particularly to a LED light device with heat dissipating arrangement for effective heat convection and brightness enhancement features.

2. Description of Related Arts

LEDs are commonly used as lighting device and are becoming more and more popular for household use for the following reasons. First, it consumes lower level of power for its low voltage requirement. Second, it generates lower level of heat which is particular important in today's increasingly hot climate condition. Third, it is energy saving. Forth, it has a long lifetime under well-controlled operative temperature.

Conversely, LED light device also has the following disadvantages. It has low level of brightness. When the ambient temperature increases, the LED light device is increasingly inefficient. In addition, the lifetime of the LED light device is greatly reduced if operated under high temperature. That is to say, high temperature is destructive to the LED light device.

A convention LED light bulb includes a light-emitting diode for light emission, a light bulb body enclosing the light-emitting diode in which a transparent light reflective surface is provided for light transmission, and a power inlet such as a plug for connecting to a power outlet for obtaining power to the light-emitting diode. The problems of low brightness and well-controlled temperature requirement are neglected and remained unsolved.

Accordingly, a heat sink can be incorporated with the conventional LED light bulb to dissipate the heat generated therefrom so as to prolong the service life span of the LED light bulb. However, during the heat dissipation of the heat sink, the air will flow turbulently so as to reduce the efficiency of the heat sink. On the other hand, the LED light bulb cannot keep the overall aesthetic appearance when it incorporates the heat sink.

SUMMARY OF THE PRESENT INVENTION

The invention is advantageous in that it provides a LED light device with a heat to dissipating arrangement for effectively guiding air flow to remove heat generated from the LED light device, so as to prolong the service life span of the LED light device.

Another advantage of the invention is to provide a LED light device, wherein the heat dissipating arrangement has a plurality of air guiding inlets aligning with the heat dissipating channels to orderly guide the air flowing through the dissipating channels from the air guiding inlets.

Another advantage of the invention is to provide a LED light device, wherein the front sides of the heat dissipating fins are concealed by the air guiding member so as to keep the aesthetic appearance of the LED light device.

Another advantage of the invention is to provide a LED light device, wherein the air is substantially guided to flow into the air guiding inlets through the guiding fins so as to enhance the cooling air being directed into the heat dissipating channels for heat dissipation of the LED light device.

Another advantage for the invention is to provide a LED light device, wherein the brightness of the LED light device is enhanced through a plurality of LEDs while the heat generated and accumulated by the LEDs is guided to direct away from the LEDs such that an ambient temperature around the LEDs is maintained and controlled at a low level which is within the operative temperature range of the LEDs.

Another advantage for the invention is to provide a LED light device, which does not require to alter the original electrical configuration of the LED light device, so as to minimize the manufacturing cost of the LED light device incorporating with the heat dissipating arrangement.

Another advantage for the invention is to provide a LED light device, wherein no expensive or complicated structure is required to employ in the present invention in order to achieve the above mentioned objects. Therefore, the present invention successfully provides an economic and efficient solution for removing the heat from the LED light device and for keeping the aesthetic appearance of the LED light device.

Additional advantages and features of the invention will become apparent from the description which follows, and may be realized by means of the instrumentalities and combinations particular point out in the appended claims.

According to the present invention, the foregoing and other objects and advantages are attained by a LED light device which comprises a LED assembly and a heat dissipating arrangement.

The LED assembly comprises a light body, one or more LEDs supported at a front side of the light body for light generation, and a power inlet operatively linked to the LEDs for connecting a power source.

The heat dissipating arrangement comprises a plurality of heat dissipating fins radially and outwardly extended from the light body to define a heat dissipating channel between every two of the heat dissipating fins, and an air guiding member coupled at the front side of the light body.

Each of the heat dissipating channels has a front opening extended at the front side of the light body and an elongated side opening for dissipating heat generated from the LED assembly.

The air guiding member has a plurality of guiding inlets aligning with the front openings of the heat dissipating channels respectively for guiding air flowing to the heat dissipating channels so as to effectively dissipating the heat from the LED assembly through the heat dissipating fins.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
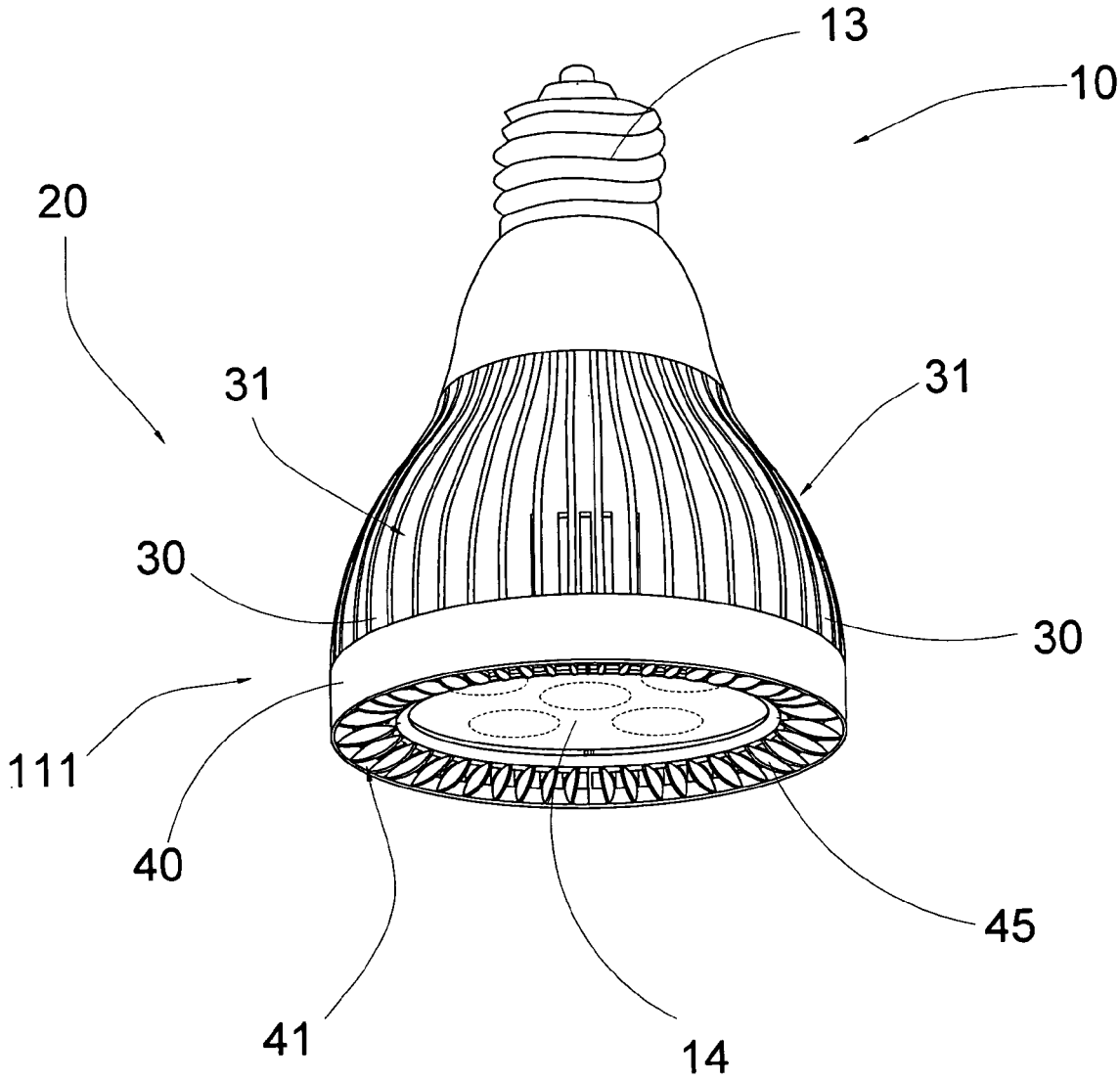
FIG. 1 is a perspective view of a LED light device according to a preferred embodiment of the present invention.

Referring to FIGS. 1 to 4 of the drawings, a LED light device according to a preferred embodiment of the present invention comprises a LED (light-emitting diode) assembly 10 and a heat dissipating arrangement 20. Accordingly, the LED light device of the present invention is embodied as a light bulb operatively coupling with an electrical socket within a light housing.

According to the preferred embodiment, the LED assembly 10 comprises a light body 11, one or more LEDs 12 supported at a front side 111 of the light body 11 for light generation, and a power inlet 13 operatively linked to the LEDs 12 for connecting a power source. Accordingly, there are six LEDs 12 orderly provided at the light body 11 for enhancing the light intensity of the LED assembly 10. Preferably, the LEDs 12 are diodes electrically coupled at a circuit board at the front side 111 of the light body.

The LED light assembly 10 further comprises a light dissipating lens 14 coupled at the front side 111 of the light body 11 for dissipating the light generated from the LEDs 12. Therefore, when the light penetrates through the light dissipating lens 14, the light will be dissipated evenly for enhancing the light projecting area of the LED assembly 10.

Accordingly, the light body 11 further has a front light cavity indented at the front side 111 of the light body 11 for the LEDs 12 disposing therein, wherein the light dissipating lens 14 is coupled at the front side 11 of the light body 11 to enclose the light cavity. The light dissipating lens 14 further comprises a plurality of light guiders 141 integrally protruded from an inner side of the light dissipating lens 14 towards the LEDs 12 respectively. Each of the light guiders 141 has a truncated cone structure that a diameter of a tapered end of the light guider 141 is smaller than that of an opposed extended end of the light guider 141. Each of the light guiders 141 further has a LED chamber 142 formed at the tapered end thereof to alignedly encircling the head portion of the respective LED 12, such that the light guider 141 will diverge the light from the LED 12 to the light dissipating lens 14. In addition, the light dissipating lens 14 has a honeycomb-structured surface which further enhances the diverged brightness of the light emitted from the LEDs 12.

According to the preferred embodiment, the heat dissipating arrangement 20 comprises a plurality of heat dissipating fins 30 and an air guiding member 40.

The heat dissipating fins 30 are radially and outwardly extended from the light body 11 to define a heat dissipating channel 31 between every two of the heat dissipating fins 30, wherein each of the heat dissipating channel 31 has a front opening 32 extended at the front side 11 of the light body 10 and an elongated side opening 33 for dissipating heat generated from the LED assembly 10.

The air guiding member 40 is coupled at the front side 11 of the light body 10, wherein the air guiding member 40 has a plurality of guiding inlets 41 aligning with the front openings 32 of the heat dissipating channels 31 respectively for guiding air flowing to the heat dissipating channels 31 so as to effectively dissipating the heat from the LED assembly 10 through the heat dissipating fins 30.

According to the preferred embodiment, each of the heat dissipating fins 30 is made of thermal conductive material to thermally conduct with the light body 11 so as to carry the heat away from the LED assembly 10. Preferably, each of the heat dissipating fins 30 is made of AA6063 aluminum alloys having a thermal conductivity of 201 W/m·K which is higher than a standard aluminum materials having a thermal conductivity of 96 W/m·K.

Figure 4:
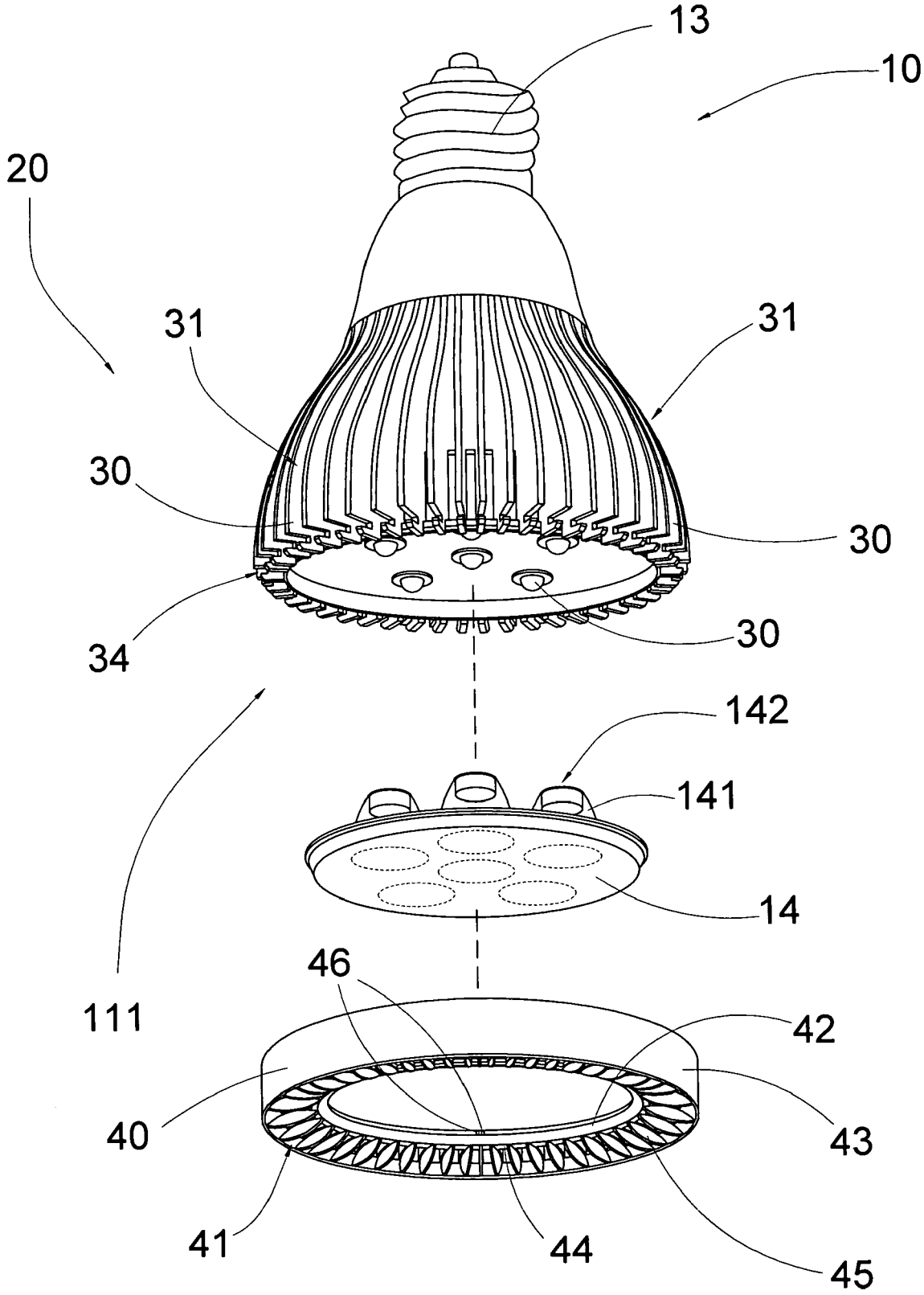
FIG. 4 is an exploded view of the LED light device according to the preferred embodiment of the present invention.

As shown in FIGS. 1 and 4, each of the heat dissipating fins 30 has an inner edge 301 extending from the light body 11, an outer edge 302 radially projected from the light body 11, and a front edge 303 extended at the front side 111 of the light body 11, wherein the heat dissipating fins 30 greatly increase the surface area thereof for spreading the heat to the surroundings effectively. It is appreciated that the light body 11 can be made of thermal conductive material such that the heat generated from the LEDs 12 can be conductively transmitted to the heat dissipating fins 30 through the light body 11.

As shown in FIGS. 1 to 4, the air guiding member 40 is made of heat insulation material to create a thermal potential difference between the heat dissipating fins 30 and the air guiding member 40 for ensuring the air being flow into the heat dissipating channels 31 through the guiding inlets 41. It is worth mentioning that if the air guiding member 40 is made of thermal conductive material as the heat dissipating fins 30, the air guiding member 40 will also conduct and dissipate the heat from the LEDs 12 as the heat dissipating fins 30 do. Therefore, it may create a turbulent air flow along the heat dissipating channels 31. In other words, when the heat is radially dissipated by the heat dissipating fins 30 from the side openings 32 of the dissipating channels 31, the cool air in the ambient environment will orderly guide to flow into the guiding inlets 41 towards the heat dissipating channels 31 for heat dissipation.

It is worth mentioning that the air guiding member 40, not only provides the guiding inlets 41 for effective convection, but its insulating nature also provides a cool surface for holding and manipulation. Also, the use of non-conductor for the air guiding member 40 further provides a temperature zone division for effective heat convection in such a manner that heat transfer between the heat dissipating fins 30 and the air guiding member 40 is limited by the insulating nature of the air guiding member 40 such that differential temperature is maintained. Therefore, cool air is sucked through the guiding inlets 41 of the air guiding member 40 to the heat dissipating channels 31 and effective heat convection is achieved.

According to the preferred embodiment, the air guiding member 40 has a ring shape encircling at the front side 111 of the light body 11 that the guiding inlets 41 are radially positioned to align with the front openings 32 of the heat dissipating channels 31 respectively. In particularly, each of the guiding inlets 41 has a size smaller than a width of the front opening 32 of the respective heat dissipating channel 31 to create a suction effect to enhance the air flowing towards the heat dissipating channels 31 through the guiding inlets 41.

According to the preferred embodiment, the air guiding member 40 further comprises an inner rim 42 encircling with the front side 111 of the light body 11 and coupling with the inner edge 301 of each of the heat dissipating fins 30, and an outer rim 43 coupling with the outer edge 302 of each of the heat dissipating fins 30 so as to conceal the front openings 32 of the heat dissipating fins 30 between the inner and outer rims 42, 43.

The air guiding member 40 further comprises a guiding wall 44 extended between the inner and outer rims 42, 43, wherein the guiding inlets 41 are evenly formed on the guiding wall 44 between the inner and outer rims 42, 43 of the air guiding member 40 to align with the front openings 32 of the heat dissipating channels 31 respectively. Therefore, when the air guiding member 40 is coupled at the front side 111 of the light body 11, the front edges 303 of the heat dissipating fins 30 are covered by the air guiding member 40 with respect to the front view of the LED light device so as to keep the overall aesthetic appearance thereof when the LED light device is supported within the light housing.

In addition, the front edge 303 of each of the heat dissipating fins is a flat front edge biasing against a rear side of the guiding wall 44 of the air guiding member 40 to substantially align the front openings 32 of the heat dissipating channels 31 with the guiding inlets 41, so as to prevent the air from being turbulently flowed to the other heat dissipating channels 31. It is worth mentioning that the light dissipating lens 14 is coupled at the front side 111 of the light body 11 and is encircled within the inner rim 403 of the air guiding member 40 to retain the light dissipating lens 14 in position.

In order to precisely align the front openings 32 of the heat dissipating channels 31 with the guiding inlets 41 respectively, the air guiding member 40 further comprises an alignment guider 46 provided at the rear side of the guiding wall 44 of the air guiding member 40 to couple with one of the front openings 32 between two corresponding heat dissipating fins 30. Accordingly, the alignment guider 46 comprises two spaced apart guider elements rearwardly and integrally extended from the guiding wall 44 at the outer rim 42, wherein a distance of the guider elements matches with a width of the front opening 32. Therefore, when the guider elements of the alignment guider 46 are positioned between two neighboring heat dissipating fins 30 within the corresponding front opening 32 thereof, the front openings 32 of the heat dissipating channels 31 will be automatically aligned with the guiding inlets 41 respectively.

As shown in FIG. 4, each of the heat dissipating fins 30 further has an engaging groove 34 indently formed at the outer edge 302 thereof to detachably couple with the outer rim 43 of the air guiding member 40 so as to securely retain the air guiding member 40 in position and to ensure the guiding inlets 41 being aligned with the front openings 32 of the heat dissipating channels 31.

Figure 2:
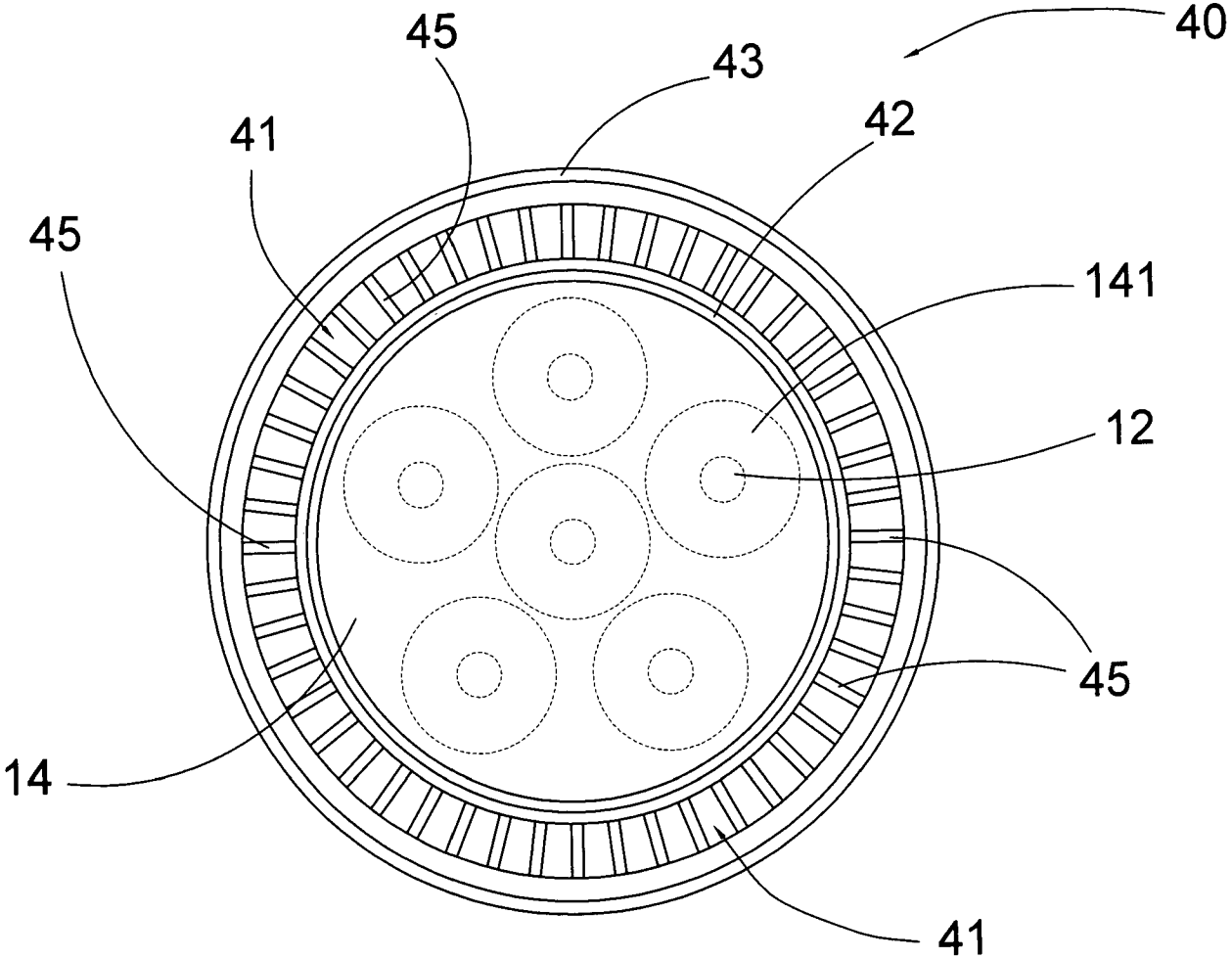
FIG. 2 is a front view of the LED light device according to the preferred embodiment of the present invention.

In order to further guide the air flowing at the guiding inlets 41, the air guiding member 40 further comprises a plurality of guiding fins 45 extending radially at a position that each of the guiding inlets 41 is located between two of the guiding fins 45 so as to substantially guide the air flowing to the heat dissipating channel 31 through the respective guiding inlet 41. As shown in FIG. 2, the guiding fins 45 are radially and integrally extended from the inner rim 42 to the outer rim 43.

Figure 3:
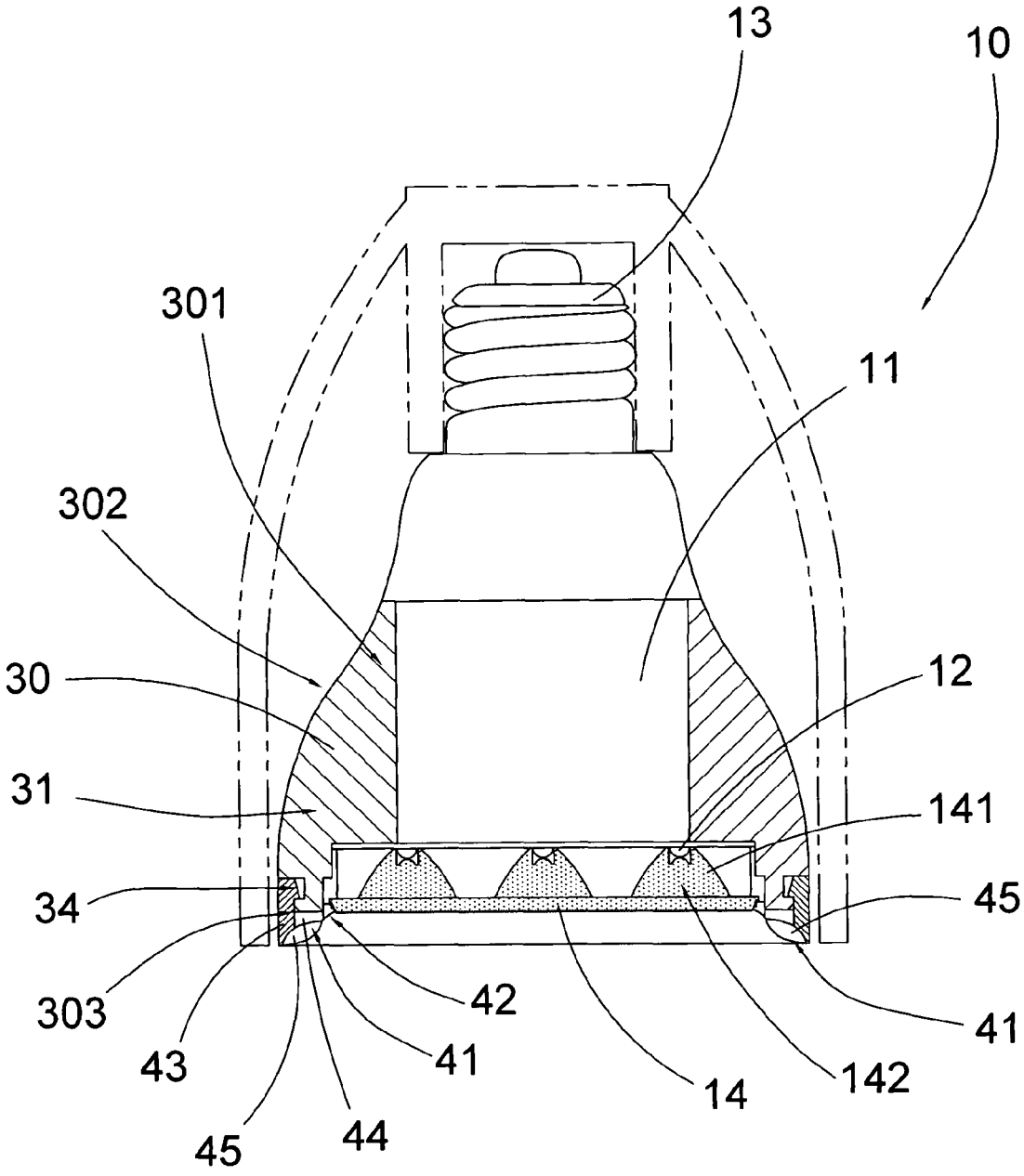
FIG. 3 is a sectional view of the LED light device according to the preferred embodiment of the present invention.

As shown in FIG. 3, a width of the outer rim 43 is larger than a width of the inner rim 42 to form a concave configuration of the air guiding member 40. In particularly, each of the guiding fins 45 generally has a triangular shape that a height of the guiding fin 45 is increasing from the inner rim 42 to the outer rim 43 to efficiently guide the air flowing into the guiding inlets 41.

According to the preferred embodiment, when the LED light device of the present invention is operatively connected to the electrical socket within the light housing, the LED assembly 10 is electrically connected to the power source via the power inlet 13. During the operation, the LEDs 12 will generate light and heat as well. Then, the heat will be guided and dissipated through the heat dissipating fins 30 at a radial direction with respect to the light body 11. Therefore, the cool air will be sucked into the guiding inlets 41 towards the heat dissipating channels 31 to efficiently remove the heat from the heat dissipating fins 30.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A LED light device, comprising: a LED assembly which comprises a light body, one or more LEDs supported at a front side of said light body for light generation, and a power inlet operatively linked to said LEDs for connecting a power source; and a heat dissipating arrangement, which comprises: a plurality of heat dissipating fins radially and outwardly extended from said light body to define a heat dissipating channel between every two of said heat dissipating fins, wherein each of said heat dissipating channel has a front opening extended at said front side of said light body and an elongated side opening for dissipating heat generated from said LED assembly; and an air guiding member coupled at said front side of said light body, wherein said air guiding member has a plurality of guiding inlets aligning with said front openings of said heat dissipating channels respectively for guiding air flowing to said heat dissipating channels so as to effectively dissipating said heat from said LED assembly through said heat dissipating fins;

wherein said air guiding member has a ring shape encircling at said front side of said light body that said guiding inlets are radially positioned to align with said front openings of said heat dissipating channels respectively;

wherein said air guiding member further comprises a plurality of guiding fins extending radially at a position that each of said guiding inlets is located between two of said guiding fins so as to substantially guide said air flowing to said heat dissipating channel through said respective guiding inlet.

2. A LED light device, comprising: a LED assembly which comprises a light body, one or more LEDs supported at a front side of said light body for light generation, and a power inlet operatively linked to said LEDs for connecting a power source; and a heat dissipating arrangement, which comprises: a plurality of heat dissipating fins radially and outwardly extended from said light body to define a heat dissipating channel between every two of said heat dissipating fins, wherein each of said heat dissipating channel has a front opening extended at said front side of said light body and an elongated side opening for dissipating heat generated from said LED assembly; and an air guiding member coupled at said front side of said light body, wherein said air guiding member has a plurality of guiding inlets aligning with said front openings of said heat dissipating channels respectively for guiding air flowing to said heat dissipating channels so as to effectively dissipating said heat from said LED assembly through said heat dissipating fins;

wherein said air guiding member has a ring shape encircling at said front side of said light body that said guiding inlets are radially positioned to align with said front openings of said heat dissipating channels respectively;

wherein said air guiding member has an inner rim encircling with said front side of said light body and coupling with an inner edge of each of said heat dissipating fins, and an outer rim coupling with an outer edge of each of said heat dissipating fins so as to conceal said front openings of said heat dissipating fins between said inner and outer rims;

wherein said air guiding member further comprises a plurality of guiding fins extending radially at a position that each of said guiding inlets is located between two of said guiding fins so as to substantially guide said air flowing to said heat dissipating channel through said respective guiding inlet.

3. The LED light device, as recited in claim 2, wherein said guiding fins are radially and integrally extended from said inner rim to said outer rim.

4. A LED light device, comprising: a LED assembly which comprises a light body, one or more LEDs supported at a front side of said light body for light generation, and a power inlet operatively linked to said LEDs for connecting a power source; and a heat dissipating arrangement, which comprises: a plurality of heat dissipating fins radially and outwardly extended from said light body to define a heat dissipating channel between every two of said heat dissipating fins, wherein each of said heat dissipating channel has a front opening extended at said front side of said light body and an elongated side opening for dissipating heat generated from said LED assembly; and an air guiding member coupled at said front side of said light body, wherein said air guiding member has a plurality of guiding inlets aligning with said front openings of said heat dissipating channels respectively for guiding air flowing to said heat dissipating channels so as to effectively dissipating said heat from said LED assembly through said heat dissipating fins;

wherein said air guiding member has a ring shape encircling at said front side of said light body that said guiding inlets are radially positioned to align with said front openings of said heat dissipating channels respectively;

wherein each of said guiding inlets has a size smaller than a width of said front opening of said respective heat dissipating channel;

wherein said air guiding member has an inner rim encircling with said front side of said light body and coupling with an inner edge of each of said heat dissipating fins, and an outer rim coupling with an outer edge of each of said heat dissipating fins so as to conceal said front openings of said heat dissipating fins between said inner and outer rims;

wherein said guiding inlets are evenly formed between said inner and outer rims of said air guiding member to align with said front openings of said heat dissipating channels respectively;

wherein said air guiding member further comprises a plurality of guiding fins extending radially at a position that each of said guiding inlets is located between two of said guiding fins so as to substantially guide said air flowing to said heat dissipating channel through said respective guiding inlet.

5. The LED light device, as recited in claim 4, wherein said guiding fins are radially and integrally extended from said inner rim to said outer rim.

6. The LED light device, as recited in claim 5, wherein each of said guiding fins has a triangular shape that a height of said guiding fin is increasing from said inner rim to said outer rim.

7. The LED light device, as recited in claim 6, wherein each of said heat dissipating fins has an engaging groove indently formed at said outer edge thereof to detachably couple with said outer rim of said air guiding member so as to securely retain said air guiding member in position and to ensure said guiding inlets being aligned with said front openings of said heat dissipating channels.

8. The LED light device, as recited in claim 7, wherein each of said heat dissipating fins has a flat front edge biasing against a rear side of said air guiding member to substantially align said front openings of said heat dissipating channels with said guiding inlets.

9. The LED light device, as recited in claim 8, wherein said air guiding member further comprises an alignment guider provided at said rear side of said air guiding member to couple with one of said front openings between two corresponding heat dissipating fins so as to ensure said front openings of said heat dissipating channels aligning with said guiding inlets respectively.

10. The LED light device, as recited in claim 9, wherein said heat dissipating fins are made of thermal conductive material for heat dissipation, while said air guiding member is made of heat insulation material to create a thermal potential difference between said heat dissipating fins and said air guiding member for ensuring said air being flow into said heat dissipating channels through said guiding inlets.

11. The LED light device, as recited in claim 10, wherein said LED assembly further comprises a light dissipating lens coupled at said front side of said light body for dissipating said light generated from said LEDs, and being encircled within said inner rim of said air guiding member to retain said light dissipating lens in position.

12. The LED light device, as recited in claim 4, wherein each of said guiding fins has a triangular shape that a height of said guiding fin is increasing from said inner rim to said outer rim.

13. The LED light device, as recited in claim 4, wherein each of said heat dissipating fins has an engaging groove indently formed at said outer edge thereof to detachably couple with said outer rim of said air guiding member so as to securely retain said air guiding member in position and to ensure said guiding inlets being aligned with said front openings of said heat dissipating channels.

14. A LED light device, comprising: a LED assembly which comprises a light body, one or more LEDs supported at a front side of said light body for light generation, and a power inlet operatively linked to said LEDs for connecting a power source; and a heat dissipating arrangement, which comprises: a plurality of heat dissipating fins radially and outwardly extended from said light body to define a heat dissipating channel between every two of said heat dissipating fins, wherein each of said heat dissipating channel has a front opening extended at said front side of said light body and an elongated side opening for dissipating heat generated from said LED assembly; and an air guiding member coupled at said front side of said light body, wherein said air guiding member has a plurality of guiding inlets aligning with said front openings of said heat dissipating channels respectively for guiding air flowing to said heat dissipating channels so as to effectively dissipating said heat from said LED assembly through said heat dissipating fins;

wherein said air guiding member has a ring shape encircling at said front side of said light body that said guiding inlets are radially positioned to align with said front openings of said heat dissipating channels respectively;

wherein each of said guiding inlets has a size smaller than a width of said front opening of said respective heat dissipating channel;

wherein said air guiding member has an inner rim encircling with said front side of said light body and coupling with an inner edge of each of said heat dissipating fins, and an outer rim coupling with an outer edge of each of said heat dissipating fins so as to conceal said front openings of said heat dissipating fins between said inner and outer rims;

wherein each of said heat dissipating fins has an engaging groove indently formed at said outer edge thereof to detachably couple with said outer rim of said air guiding member so as to securely retain said air guiding member in position and to ensure said guiding inlets being aligned with said front openings of said heat dissipating channels.

15. A LED light device, comprising: a LED assembly which comprises a light body, one or more LEDs supported at a front side of said light body for light generation, and a power inlet operatively linked to said LEDs for connecting a power source; and a heat dissipating arrangement, which comprises: a plurality of heat dissipating fins radially and outwardly extended from said light body to define a heat dissipating channel between every two of said heat dissipating fins, wherein each of said heat dissipating channel has a front opening extended at said front side of said light body and an elongated side opening for dissipating heat generated from said LED assembly; and an air guiding member coupled at said front side of said light body, wherein said air guiding member has a plurality of guiding inlets aligning with said front openings of said heat dissipating channels respectively for guiding air flowing to said heat dissipating channels so as to effectively dissipating said heat from said LED assembly through said heat dissipating fins;

wherein each of said heat dissipating fins has a flat front edge biasing against a rear side of said air guiding member to substantially align said front openings of said heat dissipating channels with said guiding inlets;

wherein said air guiding member further comprises an alignment guider provided at said rear side of said air guiding member to couple with one of said front openings between two corresponding heat dissipating fins so as to ensure said front openings of said heat dissipating channels aligning with said guiding inlets respectively.

16. A LED light device, comprising: a LED assembly which comprises a light body, one or more LEDs supported at a front side of said light body for light generation, and a power inlet operatively linked to said LEDs for connecting a power source; and a heat dissipating arrangement, which comprises: a plurality of heat dissipating fins radially and outwardly extended from said light body to define a heat dissipating channel between every two of said heat dissipating fins, wherein each of said heat dissipating channel has a front opening extended at said front side of said light body and an elongated side opening for dissipating heat generated from said LED assembly; and an air guiding member coupled at said front side of said light body, wherein said air guiding member has a plurality of guiding inlets aligning with said front openings of said heat dissipating channels respectively for guiding air flowing to said heat dissipating channels so as to effectively dissipating said heat from said LED assembly through said heat dissipating fins;

wherein said heat dissipating fins are made of thermal conductive material for heat dissipation, while said air guiding member is made of heat insulation material to create a thermal potential difference between said heat dissipating fins and said air guiding member for ensuring said air being flow into said heat dissipating channels through said guiding inlets.

* * * * *